US005921892A

United States Patent [19]

Easton

[11] Patent Number: 5,921,892

[45] Date of Patent: Jul. 13, 1999

[54] UNDERWATER TREADMILL DEVICE

[75] Inventor: Richard L. Easton, Angola, Ind.

[73] Assignee: Essi-Ferno, Wilmington, Ohio

[21] Appl. No.: 08/885,542

[22] Filed: Jun. 30, 1997

[51] Int. Cl.[6] ..... A63B 22/02

[52] U.S. Cl. ..... 482/54

[58] Field of Search ..... 482/54

[56] References Cited

U.S. PATENT DOCUMENTS

| | | | |
|---|---|---|---|
| 3,941,377 | 3/1976 | Lie | 482/54 |
| 4,332,217 | 6/1982 | Davis . | |
| 4,576,376 | 3/1986 | Miller . | |
| 4,602,779 | 7/1986 | Ogden . | |
| 4,712,788 | 12/1987 | Gaudreau, Jr. . | |
| 4,776,581 | 10/1988 | Shepherdson . | |
| 4,886,266 | 12/1989 | Trulaske | 482/54 |
| 4,918,766 | 4/1990 | Leonaggeo, Jr. . | |
| 4,938,469 | 7/1990 | Crandell . | |
| 5,108,088 | 4/1992 | Keller et al. . | |
| 5,123,641 | 6/1992 | Abboudi et al. . | |
| 5,141,479 | 8/1992 | Vanjani et al. | 482/54 |
| 5,162,029 | 11/1992 | Gerard | 482/54 |
| 5,163,885 | 11/1992 | Wanzer et al. . | |
| 5,302,162 | 4/1994 | Pasero . | |
| 5,368,532 | 11/1994 | Farnet . | |
| 5,470,293 | 11/1995 | Schonenberger | 482/54 |
| 5,558,604 | 9/1996 | Hopkins . | |

*Primary Examiner*—Glenn E. Richman

*Attorney, Agent, or Firm*—Killworth, Gottman, Hagan & Schaeff, L.L.P.

[57] ABSTRACT

An underwater treadmill device is provided and includes a drive roller and an idler roller engaging opposite ends of a treadmill belt. A hydraulic motor is directly coupled to the drive roller for imparting rotary motion to the drive roller and the treadmill belt. The hydraulic motor is driven by a remotely located pump and electrical motor. The electrical motor drives the pump and thereby controls the speed of the hydraulic motor. The speed of the electrical motor may be controlled by a remote control unit which transmits signals in the electromagnetic spectrum. The idler roller does not include any bearings as a substantially frictionless portion rotates about another portion.

27 Claims, 3 Drawing Sheets

UNDERWATER TREADMILL DEVICE

BACKGROUND OF THE INVENTION

The present invention relates in general to an apparatus for exercise and physical therapy, and, more particularly, to an underwater treadmill device which enables the exerciser to utilize the effects of buoyancy and resistance of water in walking, jogging and running.

Treadmills have become increasingly popular as a form of exercise and therapy. Individuals may adjust the speed and resistance of the treadmill to suit their exercise requirements while avoiding inclement weather conditions and poor outside running surfaces. Dry treadmills are in widespread use and are typically found in health clubs, rehabilitation facilities and home gyms. Submerged or underwater treadmills are becoming more common as the benefits of running, jogging or walking on a dry treadmill are combined with the natural resistance and buoyancy of water to reduce the strain and stress on the user's joints. Representative treadmills of the submerged or underwater type are disclosed in U.S. Pat. Nos. 4,332,217 to Davis, 4,576,376 to Miller, 4,712,788 to Gaudreau, Jr., 4,776,581 to Shepherdson, 4,938,469 to Crandell, 5,108,088 to Keller et al., 5,123,641 to Abboudi et al. and 5,558,604 to Hopkins.

However, underwater treadmills have a series of problems which are unique to their environment. An underwater treadmill has unique power requirements as it must have the ability to deliver the necessary power to the treadmill so that it can operate over a wide range of speeds and overcome the resistive effects of water while completely isolating the electrical power source from the water. Additional resistance is imposed each time the foot is planted on the treadmill surface which, when combined with the isolated motive power source, tends to cause a jerky motion in the treadmill. Further, by virtue of the buoyant effects of the water, there is a tendency for each foot plant to cause some water to squirt from beneath the treadmill, thereby causing the tail end of the treadmill to lift upwards. Finally, in swimming pools, exercise pools and the like, all metal objects associated with the treadmill must be connected to an electrically grounded pool bonding grid which tends to induce corrosion in the metal parts of the treadmill.

Accordingly, there is an ongoing need for an underwater treadmill having a motor which is capable of delivering a wide range of power and torque to the treadmill. There is also a need for a treadmill device having an electrical motor powering the motor to the drive roller which is remotely positioned and electrically isolated from the water, and which may be remotely controlled by the user while in the water. There is a further need for an underwater treadmill having a reduced number of metallic parts which is light weight, structurally stable and inexpensive to manufacture and operate.

SUMMARY OF THE INVENTION

The present invention meets these needs by providing an underwater treadmill device having a motor directly coupled to the drive roller which is capable of delivering a wide range of power and torque to the treadmill. These needs are also met by providing a treadmill device having an electrical motor powering the motor to the drive roller which is remotely positioned and electrically isolated from the water, and which may be remotely controlled by the user.

In accordance with one aspect of the present invention, a treadmill device is provided and comprises a frame, an endless treadmill belt, a drive roller and an idler roller coupled to the frame and engaging opposite ends of the endless treadmill belt, and a fluid-powered motor directly coupled to the drive roller. The fluid-powered motor imparts rotary motion to the drive roller which in turns imparts rotary motion to the treadmill belt. The treadmill device may be at least partially submerged in a body of water. The fluid-powered motor preferably has a torque of at least 9 Nm. The fluid-powered motor may be driven by a fluid pump while the fluid pump may be driven by a variable speed drive motor. The treadmill device may further comprise a remote control unit transmitting a signal in the electromagnetic spectrum to control a speed of the variable speed motor. The signal may be a radio frequency signal. The variable speed motor may comprise a cut-off sensor to prevent the variable speed motor from stalling.

The idler roller may comprise a first shaft superposed over a second shaft with water acting as a lubricant to facilitate movement between the first and second shafts. The first shaft may be comprised of an ultrahigh molecular weight (UHMW) plastic such as polyproylene while the second shaft may be comprised of stainless steel. The first shaft may further comprise a plurality of roller portions. The drive roller may comprise a first outer portion having a diameter of increasing cross-section and a second outer portion having a diameter of increasing cross-section. The drive roller may further comprise a crowned inner portion. The drive roller may also comprise a textured portion.

The frame may comprise a flexible platform extending between an upper and lower course of the treadmill belt providing support for the upper course of the treadmill belt and a cushion for each step taken on the treadmill belt. The treadmill device may further comprise at least one negative pressure fastening device coupled to the frame for securing the frame to a surface. In the preferred embodiment, the treadmill device includes a plurality of such negative pressure fastening devices.

In accordance with another aspect of the present invention, a treadmill device is provided and comprises a frame, an endless treadmill belt, a drive roller and an idler roller coupled to the frame and engaging opposite ends of the endless treadmill belt, a motor coupled to the drive roller and imparting rotary motion to the drive roller, and at least one negative pressure fastening device coupled to the frame for securing the frame to a surface.

In accordance with yet another aspect of the present invention, a treadmill device is provided and comprises a frame, an endless treadmill belt, a drive roller and an idler roller coupled to the frame and engaging opposite ends of the endless treadmill belt, and a motor coupled to the drive roller and imparting rotary motion to the drive roller. The idler roller does not comprise bearings.

In accordance with a still further aspect of the present invention, a treadmill device is provided and comprises a frame, an endless treadmill belt, a drive roller and an idler roller coupled to the frame and engaging opposite ends of the endless treadmill belt, a fluid-powered motor coupled to the drive roller and imparting rotary motion to the drive roller, a fluid pump driving the fluid-powered motor, a variable speed drive motor driving the fluid pump, and a remote control unit transmitting a signal in the electromagnetic spectrum to control a speed of the variable speed motor.

In accordance with a yet still further aspect of the present invention, a treadmill device is provided and comprises a frame, an endless treadmill belt, a flexible platform extending between an upper and lower course of the treadmill belt providing support for the upper course of the treadmill belt and a cushion for each step taken on the treadmill belt, a drive roller and an idler roller coupled to the frame and engaging opposite ends of the endless treadmill belt with the idler roller comprising a substantially frictionless first roller superposed over a second roller, a fluid-powered motor coupled to the drive roller imparting rotary motion to the drive roller, a fluid pump driving the fluid-powered motor, a variable speed drive motor driving the fluid pump, a remote control unit transmitting a signal in the electromagnetic spectrum to control a speed of the variable speed motor, and at least one negative pressure fastening device coupled to the frame for securing the frame to a surface.

Accordingly, it is an object of the present invention to provide an underwater treadmill having motor directly coupled to the drive roller which is capable of delivering a wide range of power and torque to the treadmill. It is a further object of the present invention to provide an underwater treadmill having an electrical motor powering the motor to the drive roller which is remotely positioned and electrically isolated from the water, and which may be remotely controlled by the user. It is a still further object of the present invention to provide a treadmill device having a reduced number of metallic parts which is light weight, structurally stable and inexpensive to manufacture and operate. Other features and advantages of the invention will be apparent from the following description, the accompanying drawings and the appended claims.

DETAILED DESCRIPTION OF THE INVENTION

Figure 1:
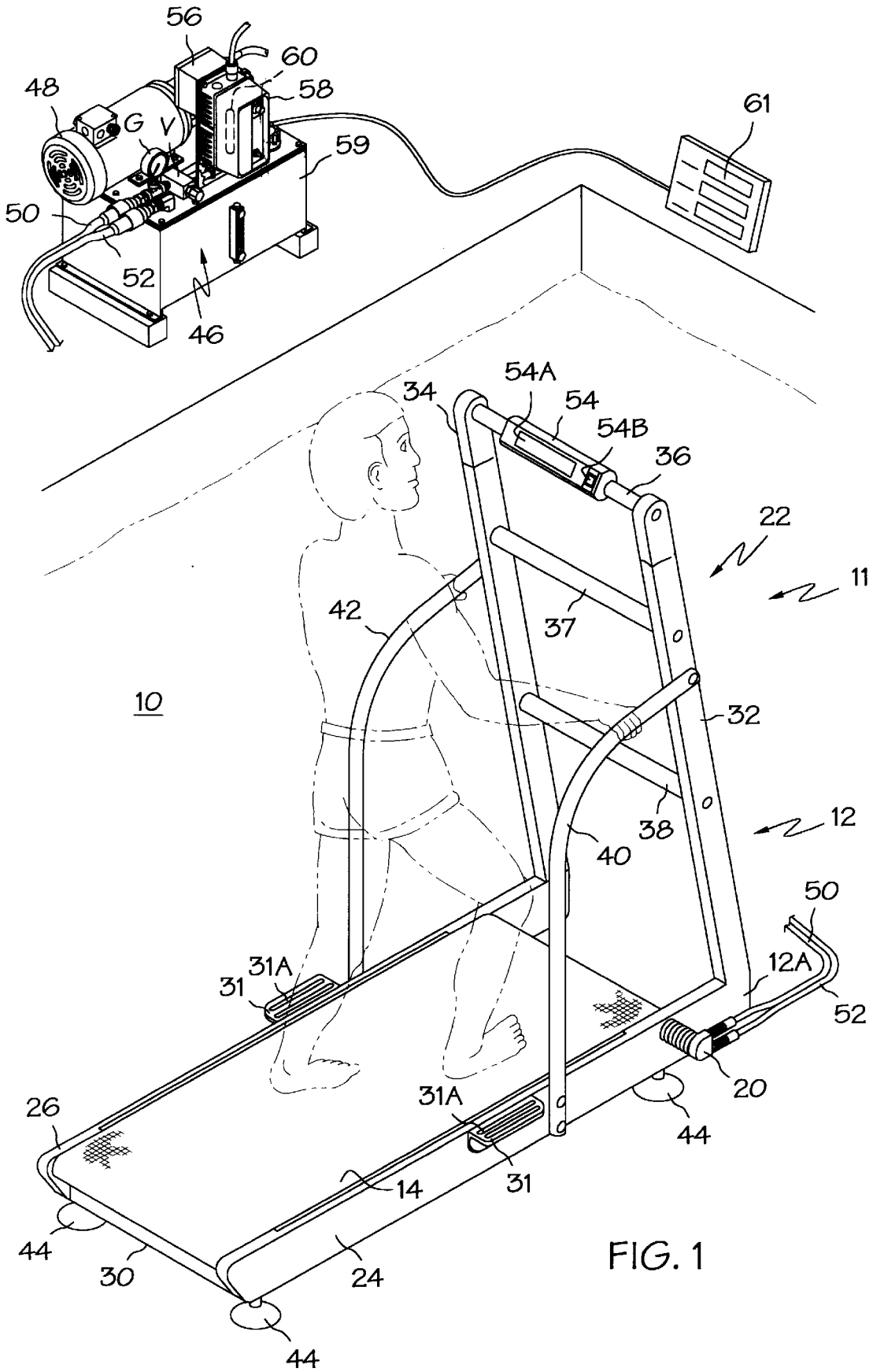
FIG. 1 is a perspective view of a treadmill device according to an aspect of the present invention.
Figure 2:
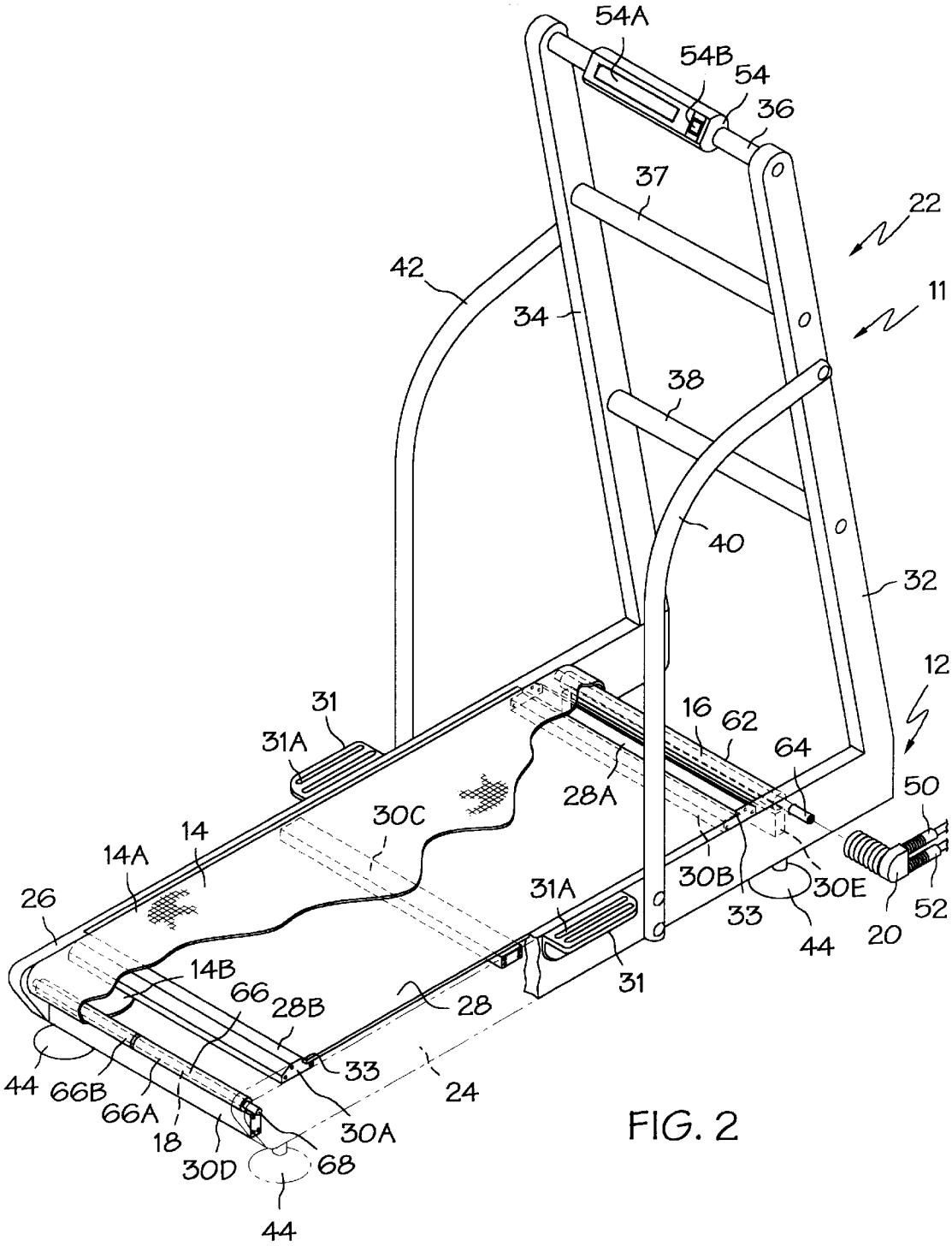
FIG. 2 is a partial cut-away view of the treadmill device of FIG. 1.

Referring now to FIGS. 1 and 2, an underwater treadmill device 10 comprising a treadmill unit 11 is shown. As shown in detail in FIG. 2, the treadmill unit 11 comprises a frame 12, an endless treadmill belt 14, a drive roller 16, an idler roller 18, and a hydraulic motor 20. The frame 12 provides the structural support for the treadmill unit 11 and comprises a handle assembly 22, a right frame member 24, a left frame member 26, a platform 28, a plurality of cross-supports 30, and a pair of running boards 31.

The drive roller 16 and the idler roller 18 are coupled to opposite ends of the right and left frame members 24, 26 using conventional fasteners. The frame members 24, 26 each include a longitudinally running groove (not shown) for receiving the platform 28. The platform 28 is coupled to the groove within the frame members 24, 26 using conventional fasteners and extends between the rollers 16 and 18. The treadmill belt 14 is trained over the rollers 16, 18 with the platform 28 extending between an upper course 14A and a lower course 14B of the treadmill belt 14. The rollers 16, 18 engage opposite ends of the belt 14 while the platform 28 supports the upper course 14A of the belt 14. The upper course 14A of the belt 14 provides a support surface upon which an exerciser may stride upon, e.g. walk, jog or run.

The cross-supports 30 are coupled to the frame members 24, 26 using conventional fasteners and provide additional support to the frame 12 and the platform 28. As shown in the illustrated embodiment, two of the cross-supports 30A and 30B are positioned at opposite ends of the platform 28 as well as slightly behind and in front of the drive roller 16 and the idler roller 18, respectively, while another cross-support 30C is positioned substantially at the midpoint of the platform 28. Further, the cross-supports 30A and 30B include shoulder portions 33 for receiving and supporting the front and rear edges 28A, 28B of the platform 28. The cross-supports 30A-30C provide primary structural support for the platform 28 and secondary structural support for the treadmill unit 11. The other two cross-supports 30D and 30E are positioned at opposite ends of the right and left frame members 24, 26 just beneath the rollers 16 and 18. It will be appreciated by those skilled in the art that a reasonable number of cross-supports 30 may be positioned in order to provide structural support for the frame members 24, 26 and the platform 28.

The running boards 31 are coupled to the frame members 24 and 26 using conventional fasteners. The running boards 31 provide a stationary surface for placement of the exerciser's feet. The running boards 31 may be used prior to the exercise routine to allow the treadmill belt 14 to come to speed before 15 the user steps onto the belt 14. In addition, the running boards 31 allow the exerciser to terminate the exercise routine by stepping onto the running boards 31 before the belt 14 stops. The running boards 31 include a non-skid surface 31A which may comprise separate non-skid pads added to the running boards or which may be formed as part of the running boards 31 by scoring or texturizing the running boards 31. It will be appreciated by those skilled in the art that the running boards 31 may be separate and distinct members or formed integral with the frame members 24 and 26.

In addition to supporting the upper course 14A of the belt 14, the platform 28 is flexible to cushion each step taken on the treadmill device 11. The platform 28 is also smooth and comprised of a substantially frictionless material so as not to interfere with the rotation of the belt 14. In the illustrated embodiment, the platform 28 is comprised of ultrahigh molecular weight (UHMW) plastic which is substantially frictionless and elastic with a high tensile strength. The belt 14 is comprised of a polyvinylchloride (PVC) material which is compatible with the rollers 16, 18 and the platform 28.

The handle assembly 22 is coupled to the front end 12A of the frame 12. The handle assembly 22 comprises a right upright member 32 and a left upright member 34 coupled to the right and left frame members 24 and 26, respectively, using conventional fasteners. The handle assembly 22 also comprises a plurality of crossbars 36, 37 and 38 coupled to and extending between the right and left upright members 32 and 34. The handle assembly 22 further comprises right and left arm rails 40 and 42 coupled to corresponding frame members 24, 26 and upright members 32, 34 using conventional fasteners. It will be appreciated by those skilled in the art that the treadmill device 11 may also include rotatable poles (not shown) coupled to the frame members 24 and 26 to add an upper body motion to the exercise. The rotatable poles may be used in addition to the arm rails 40 and 42 or in place of the arm rails 40 and 42.

Figure 3:
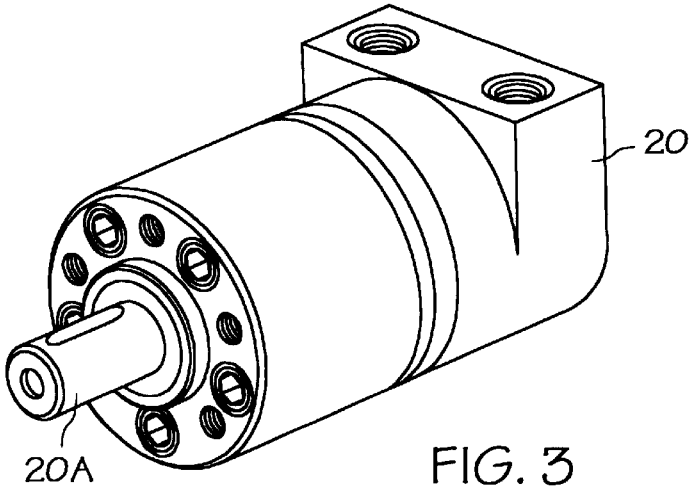
FIG. 3 is a perspective view of a hydraulic motor of the treadmill device of FIG. 1.

The hydraulic motor 20 is directly coupled to the drive roller 16. The hydraulic motor 20 is a fluid-powered motor which imparts rotary motion to the drive roller 16 through the transfer of pressurized fluid as described herein. The hydraulic motor 20 includes a set of internal gears (not shown) which are coupled to a shaft 20A, see also FIG. 3. The flow of the pressurized fluid through the hydraulic motor 20 causes the internal gears to rotate which in turn causes the shaft 20A to rotate. The drive roller 16 is coupled to the shaft 20A by conventional fasteners. The drive roller 16 rotates with the shaft 20A thereby causing the belt 14 to rotate as it is driven by the drive roller 16. The hydraulic motor 20 is capable of driving the belt 14 at speeds ranging between about 1 to about 5 miles per hour (mph) for the user. The hydraulic motor 20 is a direct drive motor as it is directly coupled to the drive roller 16, and therefore, directly transfers its rotational energy to the drive roller 16 without any intervening gears, belts or flywheels.

In the illustrated embodiment and as shown in FIG. 1, the treadmill unit 11 is partially submerged in a body of water, such as a swimming pool, exercise pool or tank, with at least the crossbar 36 exposed. As shown in FIGS. 1 and 2, the treadmill unit 11 is secured to the bottom of the pool via negative pressure fastening devices 44. The negative pressure fastening devices 44 are coupled to each corner of the frame 12. The negative pressure fastening devices 44, large suction cups approximately 5" (12.7 cm) in diameter in the illustrated embodiment, anchor the treadmill unit 11 in place and provide another level of cushioning for the exerciser. The large suction cups are comprised of an elastomeric material, such as natural or synthetic rubber. The negative pressure fastening devices 44 are coupled to the frame members 24 and 26 via an adjustable screw (not shown) so that the treadmill unit 11 may be easily leveled in the pool. It will be appreciated by those skilled in the art that other negative pressure devices may be used to secure the treadmill unit 11 to the bottom of the pool.

The hydraulic motor 20 is a high torque motor which preferably delivers at least 9 Newton-meters (Nm) of torque to the drive roller 16. In the illustrated embodiment, the hydraulic motor 20 delivers torque in the range of 10–100 Nm, and typically in the range of 14–52 Nm. It should be apparent that the hydraulic motor 20 may have any reasonable upper torque limit as the lower torque value is the design limiting feature of the treadmill unit 11, i.e. as the efficiency of the treadmill unit 11 increases the required minimum torque decreases.

Dry treadmills typically employ a DC motor to maintain a smooth running condition so that each time a user steps on the treadmill belt, referred to as a "foot-plant," a sensor instantly picks up the slight increase in resistance and a controller directs a signal to the motor to respond with pulses of extra power. This happens in milliseconds and causes the treadmill belt to move smoothly. In addition, a flywheel is usually mounted next to the electrical motor to assist in maintaining the smooth running condition and overcoming the resistance of the foot-plants. In an underwater treadmill, the resistance or pause from a foot-plant can be quickly detected but the electrical motor is sufficiently removed from the treadmill device that it requires about one second for the extra energy in the hydraulic line to arrive at the hydraulic motor, resulting in a rough or jerky moving treadmill belt. Torque of approximately 9 Nm is sufficient to initially start rotation of the drive roller 16 and the belt 14 as well as to overcome the additional resistance associated with each foot-plant. The high torque hydraulic motor 20 is able to compensate for the additional resistance associated with each foot-plant, thereby alleviating the need for a resistance sensor or a flywheel.

The treadmill device 10 includes a fluid pump 46 and a variable speed electrical motor 48. The hydraulic motor 20 is driven by the fluid pump 46, while the fluid pump 46 is driven by the variable speed electrical motor 48. The pump 46 and the electrical motor 48 are located at a remote location from the hydraulic motor 20 as the electrical motor 48 needs to be physically separate from the water for obvious safety reasons. The fluid pump 46 is therefore coupled to the hydraulic motor 20 via a pair of hydraulic hoses 50 and 52. Hydraulic hose 50 is a supply hose which transfers the hydraulic fluid from the pump 46 to the hydraulic motor 20. Hydraulic hose 52 is a return hose which transfers the hydraulic fluid from the hydraulic motor 20 back to the pump 46 and into a fluid reservoir 59. In the illustrated embodiment, the fluid reservoir 59 holds approximately 10 gallons of FDA approved food grade hydraulic fluid. Food grade hydraulic fluid is compatible with the pool environment as any leakage of fluid is relatively harmless. The pump 46 also includes a filter (not shown) in the fluid reservoir 59 for filtering any contaminants from the hydraulic fluid, a pressure gauge G for monitoring the fluid pressure and a pressure relief valve V for relieving the fluid pressure in the an event of a failure in the pump 46. The electrical motor 48 is hard-wired to a power source, for example, a single phase or three phase 20 amp/208–240 VAC source.

The electrical motor 48 controls the speed of the hydraulic motor 20 by controlling the fluid flow through the pump 46. The rate at which the hydraulic fluid flows, and hence, the speed of the hydraulic motor 20, is directly proportional to the speed at which the electrical motor 48 drives the pump 46. As the speed of the electrical motor 48 increases, the pressure generated by the pump 46 increases thereby increasing the fluid rate to the hydraulic motor 20. Accordingly, the speed of the hydraulic motor 20 and the treadmill belt 14 may be controlled by controlling the speed of the electrical motor 48.

As shown in FIG. 1, the speed of the electrical motor 48 is controlled by a remote control unit 54, a receiver 56 and a controller 58. The remote control unit 54 is coupled to the cross-bar 38 while the receiver 56 and the controller 58 are coupled to the electrical motor 48. The remote control unit 54 is battery operated and includes an instruction plate 54A, a switching unit 54B and a transmitter (not shown). The instruction plate 54A includes instructions for changing the current speed of the treadmill belt 14 via the switching unit 54B. The switching unit 54B may comprise, for example, a rotary dial, a linear switch or a set of push-buttons for raising or lowering the speed of the belt 14. The transmitter transmits a signal in the electromagnetic spectrum representative of the desired speed of the belt 14 based on the value set by the switching unit 54B. The receiver 56 detects the signal from the remote control unit 54 and transmits the signal to the controller 58. The controller 58 interprets the signal and controls the electrical motor 48 so that the belt 14 operates at the desired speed of about 1 to 5 mph.

The treadmill device 10 also includes a display unit 61. The display unit 61 is positioned away from the water and includes a large display area 61A for displaying speed, distance and elapsed time. The display unit 61 may be mounted on a wall, suspended from the ceiling or positioned near the edge of the pool. The display area 61A is relatively large so that it can be easily observed from a distance. The display unit 61 is electrically coupled to the controller 58 for receiving power and the appropriate display signals. The display unit 61 may comprise a television, a computer monitor, a series of LEDs, a LCD display or the like.

The treadmill unit 11 is electrically isolated as the remote control unit 54 is battery powered, a wireless signal controls the electrical motor 48, the treadmill belt 14 is powered by a hydraulic motor 20, and the display unit 61 is positioned remotely from the water. No electrical cables contact the treadmill unit 11 in the water such that the treadmill is electrically isolated. In the illustrated embodiment, the transmitter transmits a radio frequency signal of approximately 310 MHz. However, it will be appreciated by those skilled in the art that other frequencies in the radio spectrum may be used. It will be further appreciated by those skilled in the art that other signals in the electromagnetic spectrum, such as infrared optical signals, may be used.

The electrical motor 48 includes a cut-off sensor 60. The cut-off sensor 60 monitors the speed of the electrical motor 48 and transmits a signal to the controller 58 to turn the motor 48 off when the speed drops below a predetermined value, to prevent the motor 48 from stalling. An electrical motor draws a substantial amount of current when it slows down and starts to stall such that the cut-off sensor 60 prevents the electrical motor 48 from overloading. The predetermined value at which the cut-off sensor 60 is triggered may be set at a desired value based on the particular application. For example, the predetermined value would be set lower for a user rehabilitating an injury than for a user exercising.

The treadmill belt 14 is driven by the drive roller 16. The drive roller 16 includes a first outer/drive roller portion 62 superposed over a second/drive shaft portion 64. An inner portion of the drive roller portion 62 is hex-shaped and receives a complementary hex-shaped outer portion of the drive shaft portion 64 such that the drive roller portion 62 rotates with the drive shaft portion 64. It will be appreciated by those skilled in the art that the drive roller 16 may be formed of a single integral component or a number of separate and distinct components. In the illustrated embodiment, one end of the drive shaft portion 64 is coupled to the left frame member 26 through a bearing assembly (not shown) while the other end of the drive shaft portion 64 is rigidly coupled to the drive shaft 20A of the hydraulic motor 20 through the right frame member 24.

Figure 4:
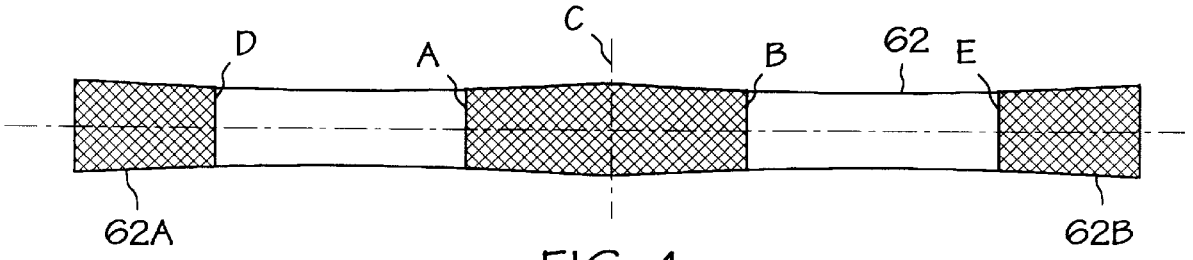
FIG. 4 is a plan view of a drive roller of the treadmill device of FIG. 1.

The surface of the drive roller portion 62 is textured to provide additional friction for rotating the treadmill belt 14. Further, the drive roller portion 62 is shaped as shown in FIG. 4 to maintain the position of the belt 14 substantially in the center of the roller portion 62. The roller portion 62 is crowned substantially in the center as the cross-section increases from points A and B to a peak at the center point C. Further, outer portions 62A and 62B of the roller portion 62 have diameters of increasing cross-section as the cross-sections increase from points D and E to the edges of the roller portion 62. This configuration keeps the treadmill belt 14 substantially centered on the roller portion 62 while providing sufficient friction to drive the belt 14.

Figure 5:
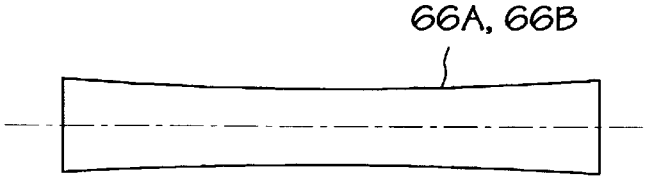
FIG. 5 is a plan view of a portion of an idler roller of the treadmill device of FIG. 1.

The idler roller 18 does not contain any bearings as bearings tend to corrode in the pool environment and require maintenance. The idler roller 16 comprises a first shaft 66 having first and second roller portions 66A and 66B superposed over a second shaft 68. In the illustrated embodiment, the second shaft 68 is comprised of stainless steel and is rigidly coupled to the frame members 24, 26. The first shaft 66 comprises a substantially frictionless material, such as UHMW plastic, and rotates about the second shaft 68. The water in the pool acts as a lubricant to maintain a smooth operating surface between the first and second shafts. The upper course 14A of the belt 14 wraps around and over the first shaft 66 as it is rotated by drive roller 16. As shown in FIG. 5, the first and second roller portions 66A and 66B are reverse crowned as the cross-section of each portion decreases in diameter from the edges to a low point substantially in the center. This configuration keeps the belt 14 from sliding off of the first shaft 66 as the belt 14 rotates. It will be appreciated that the roller portions 66A and 66B may have different configurations. It will be further appreciated by those skilled in the art that the first shaft 66 may comprise a single roller portion or a plurality of roller portions.

The treadmill unit 11 comprises a minimum of metallic components thereby reducing weight as well as manufacturing and operating costs. In the illustrated embodiment, all of the components which form the frame 12, except the platform 28, are comprised of a lightweight, non-metallic material, such as UHMW polypropylene. Polypropylene is lightweight, inexpensive to manufacture, and compatible with the water environment as it does not rust, corrode or require any special grounding requirements. It will be appreciated by those skilled in the art that other lightweight, non-metallic materials may be used to form the bulk of the treadmill device 10.

Having described the invention in detail and by reference to preferred embodiments thereof, it will be apparent that modifications and variations are possible without departing from the scope of the invention defined in the appended claims.

What is claimed is:

1. A treadmill device comprising:

a frame;

an endless treadmill belt;

a drive roller and an idler roller coupled to said frame and engaging opposite ends of said endless treadmill belt, said drive roller comprising a first outer portion terminating in a first edge and a second outer portion terminating in a second edge, said first outer portion having a diameter of increasing cross-section in a direction of said first edge and said second outer portion having a diameter of increasing cross-section in a direction of said second edge; and a fluid-powered motor directly coupled to said drive roller, said fluid-powered motor imparting rotary motion to said drive roller.

2. The treadmill device of claim 1, wherein said treadmill device is at least partially submerged in a body of water.

3. The treadmill device of claim 1, wherein said fluid-powered motor has a torque of at least 9 Nm.

4. The treadmill device of claim 1, wherein said fluid-powered motor is driven by a fluid pump and said fluid pump is driven by a variable speed drive motor.

5. The treadmill device of claim 4, further comprising a remote control unit, said remote control unit transmitting a signal in the electromagnetic spectrum to control a speed of said variable speed motor.

6. The treadmill device of claim 5, wherein said signal is a radio frequency signal.

7. The treadmill device of claim 4, wherein said variable speed motor comprises a cut-off sensor to prevent said variable speed motor from stalling.

8. The treadmill device of claim 1, wherein said idler roller comprises a first shaft superposed over a second shaft.

9. The treadmill device of claim 8, further comprising water acting as a lubricant to facilitate movement between said first and second shafts.

10. The treadmill device of claim 8, wherein said first shaft comprises UHMW plastic.

11. The treadmill device of claim 10, wherein said second shaft comprises stainless steel.

12. The treadmill device of claim 8, wherein said first shaft comprises a plurality of roller portions.

13. The treadmill device of claim 1, wherein said drive roller further comprises a crowned inner portion.

14. The treadmill device of claim 1, wherein said drive roller comprises a textured portion.

15. The treadmill device of claim 1, wherein said frame further comprises a flexible platform extending between an upper and lower course of said treadmill belt, said flexible platform providing support for said upper course of said treadmill belt and a cushion for each step taken on said treadmill belt.

16. The treadmill device of claim 1, further comprising at least one negative pressure fastening device coupled to said frame for securing said frame to a surface.

17. The treadmill device of claim 15, further comprising a plurality of said negative pressure fastening devices.

18. A treadmill device comprising:

a frame;

an endless treadmill belt;

a drive roller and an idler roller coupled to said frame and engaging opposite ends of said endless treadmill belt, said idler roller does not comprise bearings; and a motor coupled to said drive roller, said motor imparting rotary motion to said drive roller.

19. The treadmill device of claim 18, wherein said idler roller comprises an first shaft superposed over a second shaft.

20. The treadmill device of claim 19, further comprising water acting as a lubricant to facilitate movement between said first and second shafts.

21. The treadmill device of claim 19, wherein said first shaft comprises UHMW plastic.

22. The treadmill device of claim 21, wherein said second shaft comprises stainless steel.

23. The treadmill device of claim 19, wherein said first shaft comprises a plurality of roller portions.

24. A treadmill device comprising:

a frame;

an endless treadmill belt;

a drive roller and an idler roller coupled to said frame and engaging opposite ends of said endless treadmill belt;

a fluid-powered motor coupled to said drive roller, said fluid-powered motor imparting rotary motion to said drive roller;

a fluid pump driving said fluid-powered motor;

a variable speed drive motor driving said fluid pump; and a remote control unit transmitting a signal in the electromagnetic spectrum to control a speed of said variable speed motor.

25. The treadmill device of claim 24, wherein said signal is a radio frequency signal.

26. A treadmill device comprising:

a frame;

an endless treadmill belt;

a flexible platform extending between an upper and lower course of said treadmill belt, said flexible platform providing support for said upper course of said treadmill belt and a cushion for each step taken on said treadmill belt;

a drive roller and an idler roller coupled to said frame and engaging opposite ends of said endless treadmill belt, said idler roller comprising a substantially frictionless first roller superposed over a second roller;

a fluid-powered motor coupled to said drive roller, said fluid-powered motor imparting rotary motion to said drive roller;

a fluid pump driving said fluid-powered motor;

a variable speed drive motor driving said fluid pump;

a remote control unit transmitting a signal in the electromagnetic spectrum to control a speed of said variable speed motor; and at least one negative pressure fastening device coupled to said frame for securing said frame to a surface.

27. A treadmill device comprising:

a frame;

an endless treadmill belt;

a drive roller and an idler roller coupled to said frame and engaging opposite ends of said endless treadmill belt, said drive roller comprising a crowned inner portion; and a fluid-powered motor directly coupled to said drive roller, said fluid-powered motor imparting rotary motion to said drive roller.

* * * * *